United States Patent [19]

Yodice

[11] Patent Number: 5,072,770

[45] Date of Patent: Dec. 17, 1991

[54] INVESTMENT CASTING PROCESS

[76] Inventor: Daniel B. Yodice, 31 Hillcrest Ave., Worcester, Mass. 01602

[21] Appl. No.: 543,038

[22] Filed: Jun. 22, 1990

[51] Int. Cl.[5] ..... B22C 9/02; B22C 7/02

[52] U.S. Cl. ..... 164/34; 164/45

[58] Field of Search ..... 164/34, 35, 36, 45

[56] References Cited

U.S. PATENT DOCUMENTS

| | | | |
|---|---|---|---|
| 3,512,571 | 5/1970 | Phelps | 164/34 |
| 3,612,147 | 10/1971 | Kaplan | 164/45 |
| 4,681,151 | 7/1987 | Koya | 164/76.1 |
| 4,940,072 | 7/1990 | Pellman | 164/34 |

FOREIGN PATENT DOCUMENTS

| | | | |
|---|---|---|---|
| 48965 | 1/1973 | Japan | 164/34 |
| 5116221 | 2/1976 | Japan | 164/34 |
| 611443 | 1/1986 | Japan | 164/34 |
| 611445 | 1/1986 | Japan | 164/35 |
| 62244548 | 10/1987 | Japan | 164/35 |
| 1369850 | 1/1988 | U.S.S.R. | 164/39 |

*Primary Examiner*—Richard K. Seidel
*Assistant Examiner*—Rex E. Pelto
*Attorney, Agent, or Firm*—Blodgett & Blodgett

[57] ABSTRACT

A method of making an investment casting by forming a pattern which has the shape of the part which is to be made and forming from the pattern a mold of elastomeric (rubber) material which has a cavity which has the shape of the of the part or casting to be made. Liquid aqueous (water) material is poured into the mold cavity and the mold is cooled so that the material is frozen (ice) to form a solid temporary pattern having the shape of the part. The temporary pattern is coated or invested with ceramic material to form a solid shell about the temporary pattern. The solid temporary pattern is melted and the resulting aqueous material evacuated from the shell to form a cavity which has the shape of the part or casting. The shell cavity is filled with molten metal which is allowed to solidify to form the casting which is removed from the shell.

11 Claims, 3 Drawing Sheets

FIG. 1
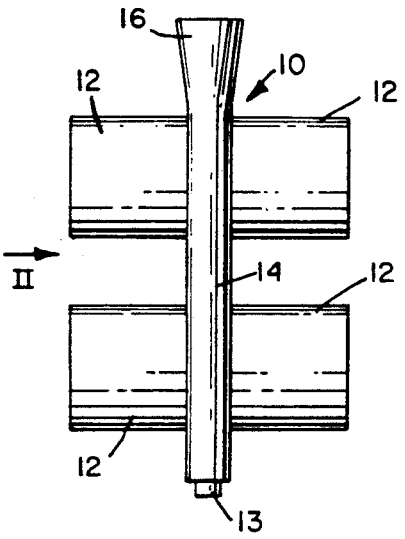
FIG. 2
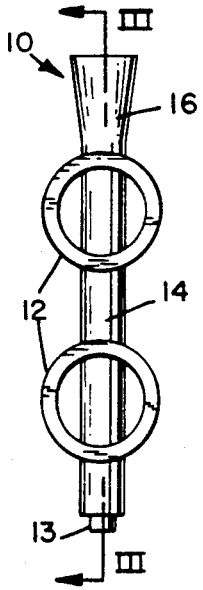
FIG. 3
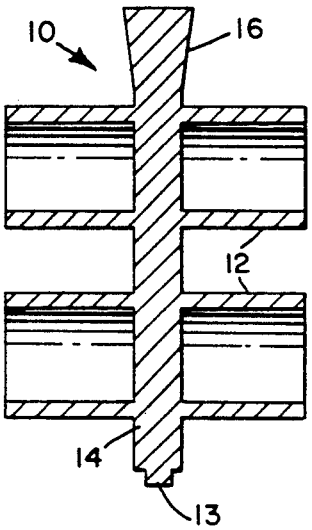
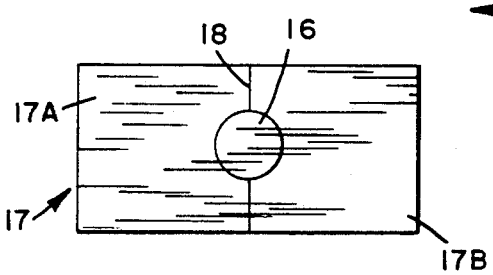
FIG. 5
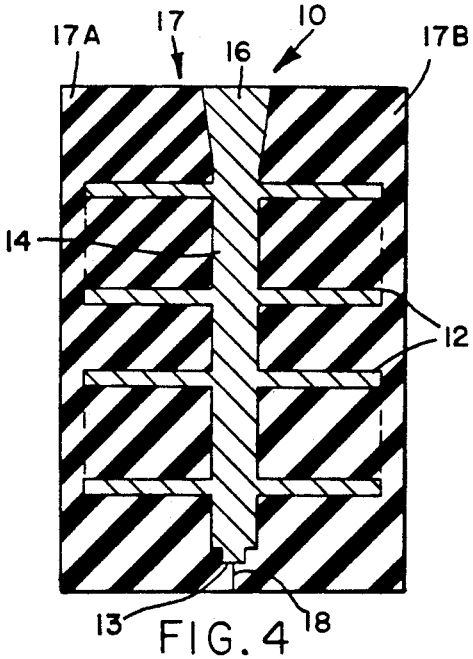
FIG. 4
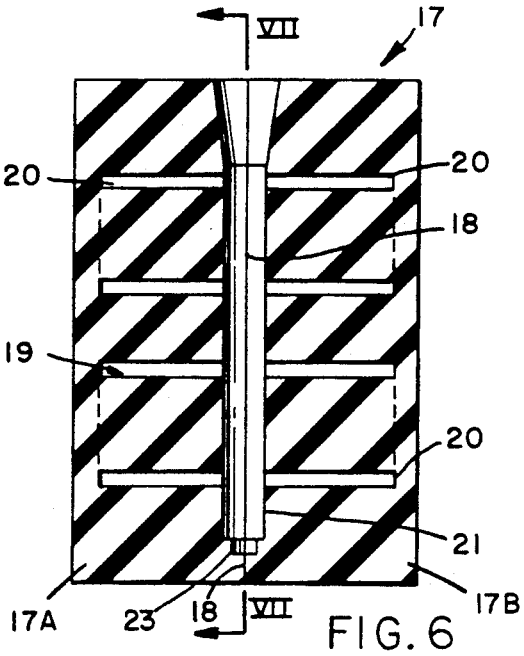
FIG. 6

FIG. 7
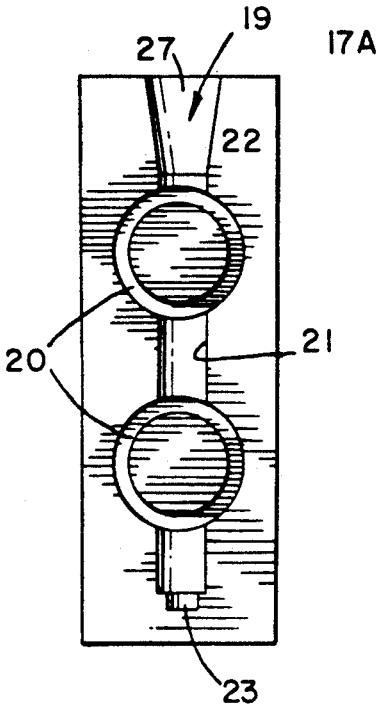
FIG. 8
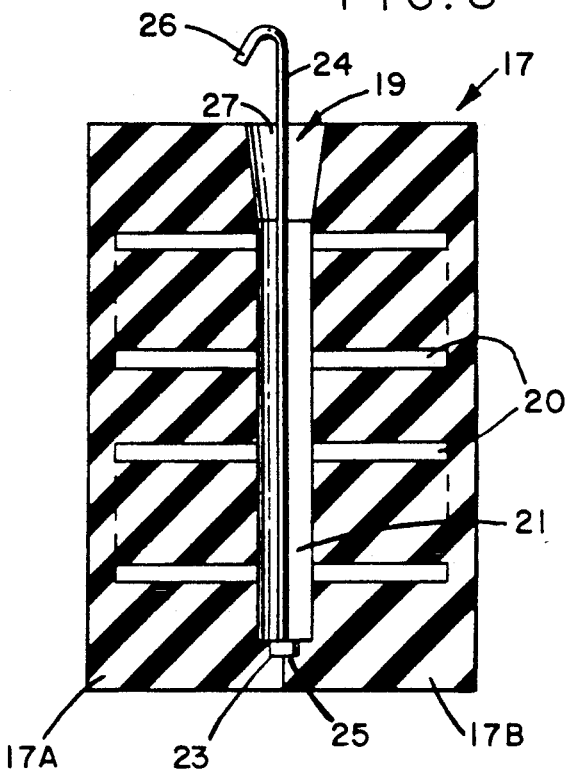
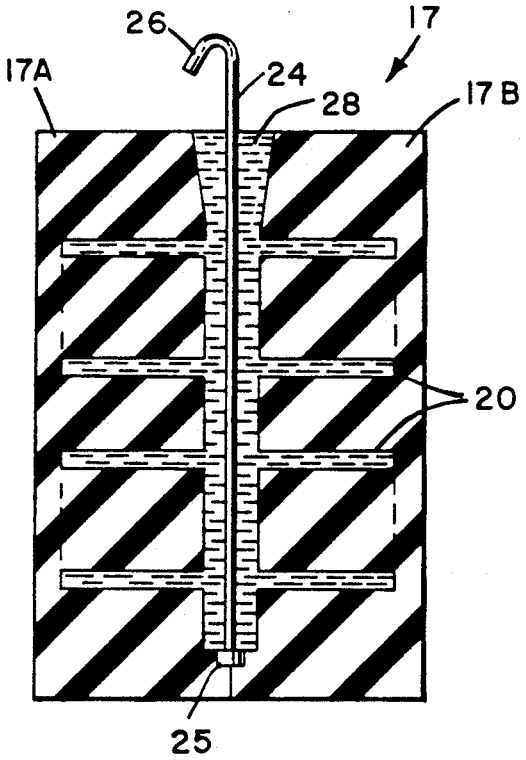
FIG. 9
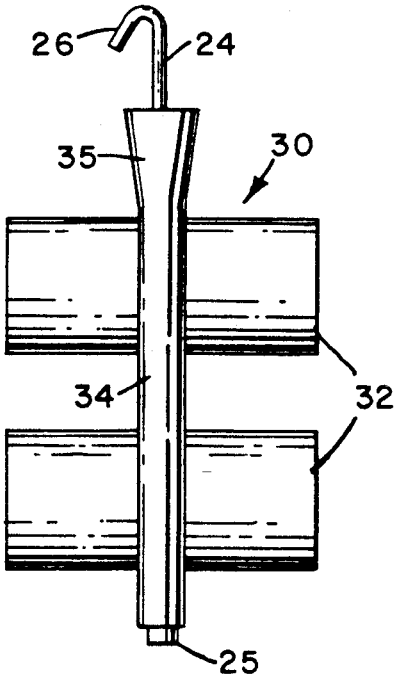
FIG. 10

INVESTMENT CASTING PROCESS

BACKGROUND OF THE INVENTION

The present invention relates to an improvement in the Investment Casting process. The Investment Casting Process or "Lost Wax" Process has been practiced for centuries. The original process consisted of forming an original wax model of the part or casting which was to be made. The wax model was coated with a slurry of plaster. Successive layers of plaster were added to the was model until a strong shell enveloped the model. A variation in the process involved dipping or "investing" the wax model into a bucket full of plaster slurry. The plaster covered model was then heated until the wax melted out of the plaster shell, thereby leaving a void which had the shape of the part which was to be made. The void was then filled with molten metal. The result was a casting was a perfect duplication of the original wax model.

The Investment Casting Process is being used extensively today as a shortcut to producing finished high quality precision parts which, otherwise, would have to be made by precision machining. Complex parts with undercut and smooth surfaces, accurate dimensions and fine details can be made by investment casting. In accordance with present day procedures, a wax pattern is made by injecting hot wax into a metal mold. The pattern has the exact geometry of the desired finished part. The pattern is slightly larger than the finished part to compensate for volumetric shrinkage of the hot wax model and metal casting during solidification. The shell is formed by dipping the wax pattern into a ceramic slurry and then coating or "stuccoing" it with fine granular ceramic material, allowed to air dry and then repeating the operation several times until a shell is formed around the pattern. In order to increase production, several wax patterns are attached to a central wax sprue and coated with ceramic material as a cluster. Each pattern has a gate which enables the pattern to be attached to the sprue and to provide a passage for drawing out the pattern material as it melts. The gates and the sprue also guide the molten metal to the voids in the ceramic shell during the casting operation.

In spite the many advantages of investment casting over other procedures, the investment casting process is still relatively time consuming and expensive. Every step of the investment casting process requires highly skilled operators and great care in carrying out the steps of the operation. Great care has to be exercised in gluing all wax patterns to the gates and the gates to the sprue, also that the wax stays at constant temperature to avoid expansion of the wax which would crack the ceramic shell. A crack in one of the layers of the shell can cause the entire shell to fracture during the steam autoclave, firing or casting steps of the process. Shell breakage affects productivity and adds substantially to the cost of the operation. Most of the damage to the shell occurs during the step of investing melting the wax in a steam autoclave. Since wax expands when heated, it must be evacuated from the ceramic shell as quickly as possible. Otherwise, the expanding wax creates an internal pressure within the shell and either breaks the shell or creates a fracture which causes the shell to break during the casting step. The wax from the melted pattern is usually not recycled to make patterns. In order to maintain the high quality which is required of investment castings, new wax must be used each time a new wax pattern is made, thereby adding considerably to the cost of the operation. These and other difficulties have been obviated by the present invention.

It is, therefore, a principal object of the invention to provide an investment casting process in which a model or pattern of the item to be made is made of a material which is liquid at room temperature and which does not expand within the shell during the step of shell building and of melting and evacuation of the model from the ceramic shell.

Another object of this invention is the provision of an investment casting process in which a cluster of models or patterns is formed in a single molding step, including pouring cup, sprue and gates.

A further object of the present invention is the provision of an investment casting process in which the model which is to be invested is made from an inexpensive recyclable material which does not expand when changing from the solid state to the molten state.

With these and other objects in view as will be apparent to those skilled in the art, the invention resides in the combination of steps set forth in the specification and covered by the claims appended hereto.

SUMMARY OF THE INVENTION

In general, the invention consists of a method of making an investment casting by forming a mold having a cavity which has the identical shape of the part or casting which is to be made. The cavity is filled with an aqueous material which is in its liquid state. The mold is cooled so that the aqueous material freezes to a solid state to form a model or temporary pattern which has the identical shape of the casting. The temporary pattern is coated or invested with a ceramic material to form a self-supporting shell of ceramic material over the temporary pattern. The ceramic shell is then brought to room temperature to liquify the temporary pattern. The liquid from the pattern is evacuated from the shell to form a cavity which has the shape of the casting. The shell is heated and filled with molten metal which is allowed to solidify to form the casting and the ceramic shell is removed from the casting.

BRIEF DESCRIPTION OF THE DRAWINGS

The character of the invention, however, may be best understood by reference to the accompanying drawings which illustrate one method of carrying out the present invention wherein:

FIG. 1 is a front elevational view of a plurality of patterns of the part which is to be made by investment casting, the pattern being shown attached to a central sprue to form a pattern cluster, FIG. 2 is a side elevational view of the pattern cluster of FIG. 1 looking in the direction of arrow II of FIG. 1, FIG. 3 is a vertical cross-sectional view of the pattern cluster along line III—III of FIG. 2 and looking in the direction of the arrows, FIG. 4 is a vertical cross-sectional view of a two part mold which is formed about the pattern cluster, FIG. 5 is a top plan view of the mold, FIG. 6 is a cross sectional view of the mold with the pattern cluster removed from the mold.

FIG. 7 is a view taken along the parting line of the mold on line VII—VII of FIG. 6 and looking in the direction of the arrow, FIG. 8 is a cross-sectional view of the mold which is similar to FIG. 6, showing a holding core within the mold cavity, FIG. 9 is a cross-sectional view which is similar to FIG. 8, showing the mold cavity filled with a liquid, FIG. 10 is a front elevational view of a temporary pattern which is formed by freezing the liquid in the mold and removing the pattern from the mold.

DETAILED DESCRIPTION OF THE INVENTION

Figure 11:
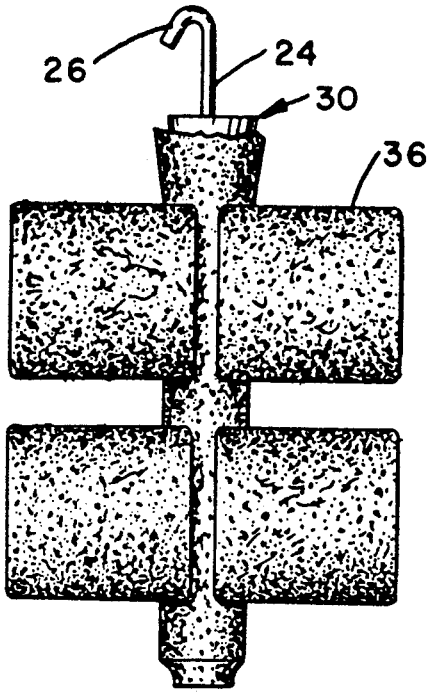
FIG. 11 is a front elevational view of the temporary pattern invested with ceramic material.

Referring first to FIGS. 1–3 the first step of the investment casting method of the present invention is the making of a pattern which has the identical shape of the casting which is to be made. The pattern can be made of any hard material about which a mold of elastomeric material can be formed. In order to maximize production, it is preferred that a plurality of patterns be formed in a cluster as shown in FIGS. 1–3 and generally indicated by the reference numeral 10. The cluster 10 includes a plurality of patterns 12 each of which has the shape of the part which is to be formed and which are attached to a central sprue 14. The upper end of the sprue 14 has an enlarged portion or cup 16, which tapers upwardly and outwardly. The lower end of the sprue has a reduced portion 13.

The second step of the process of the present invention is the formation of a mold of elastomeric material about the pattern cluster 10 as shown in FIGS. 4–7. The mold of the elastomeric material is generally indicated by the reference numeral 17 and consists of two halves **17*a* and 17*b* which are divided along a parting plane 18 which bisects the sprue 14 so that each half of the mold contains two patterns 12 as shown in FIG. 4. Each mold half is formed by pouring fluid uncured elastomeric material such as natural or synthetic rubber into an open container within which half of the pattern cluster 10 is suspended. Two elastomers which can be used for the present invention are silicone rubber and polysulfide urethane. Silicon rubber is preferred if the part to be made has fine details. The fluid elastomeric material is then cured to a solid state. The pattern 10 is removed from the mold half, thereby forming a cavity which is generally indicated by the reference numeral 19 which opens to a parting surface 22. The cavity 19 includes a sprue portion 21 and a plurality of article portions 20 which have the identical shape of the part or casting to be made. When the mold half 17*a* and 17*b* are combined, the sprue portions 21 combine into a single sprue, and the article proportions 20 extend from opposite sides of the combined sprue portion 21 and from the parting plane 18. The upper end of the sprue 21 has an enlarged portion or cup 27. The lower end of the sprue 21 has reduced portion 23**.

Referring particularly to FIGS. 8–10 the temporary pattern for investing is made by inserting an elongated holding core 24 into the sprue portion 21 of the mold cavity 19 as shown in FIG. 8. The elongated holding core 24 has an enlargement 25 at its lower end which fits into the reduced portion 23 and a hook 26 at its upper end which extends above the mold 17. After the elongated holding core 24 has been positioned within the mold cavity 19, the cavity is filled with an aqueous material such as water 28 when the material is in its liquid state. Plain water is preferred but any similar liquid or solution can be used which has similarly properties and which is relatively inexpensive. After the cavity 19 has been filled with water, the mold 17 is cooled sufficiently to cause the water 28 to freeze into a solid body. Water expands when passing from the liquid state to the solid state. The elastomeric mold 17 stretches to accommodate the expansion of the water as it changes to the solid state. The frozen body of water is then removed from the mold 17 and represents a temporary pattern cluster which is generally indicated by the reference numeral 30, as shown in FIG. 10. The temporary pattern cluster 30 includes a plurality of temporary patterns 32 which have the identical shape of the part which is to be made and which are attached to a central sprue portion 34. The top end of the sprue portion 34 has an enlarged or cup portion 35. The temporary pattern cluster 30 is maintained in an environment which is cold enough to maintain the temporary cluster 30 in the solid state. The temperature of the environment must be below the freezing temperature of the aqueous material of which the temporary pattern cluster is made and, preferably, substantially below the freezing temperature as a safeguard against accidental thawing or softening of the frozen body. For example, for water which has a freezing temperature of 32° F. it is preferred that the temperature of the environment within which the temporary pattern cluster 30 is kept be maintained at a temperature of less than 26° F. This will guarantee against fluctuations in temperature and insure that the temporary pattern cluster 30 is maintained in a solid state during its use in subsequent steps.

Figure 12:
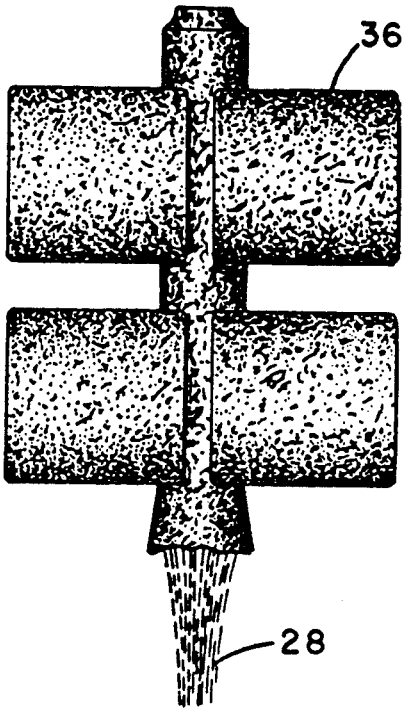
FIG. 12 is a front elevational view of the investment shell in an inverted position to enable the liquid from the pattern to be evacuated from the ceramic shell after the shell has been heated sufficiently to liquify the temporary pattern.

The next step in the Investment Casting process of the present invention consists of coating the temporary pattern cluster 30 with ceramic material to form a ceramic shell about the temporary pattern. The coating or "investing" step consists of dipping the temporary pattern cluster 30 in a container of ceramic slurry while the body is supported from the hook shaped upper portion 26 of the core 24. The investing steps involve conventional procedures. For example, the temporary pattern cluster 30 is dipped into the ceramic slurry, drained and then coated or stuccoed with fine ceramic sand. After drying, this process is repeated several more times until a self-supporting shell has been formed about the temporary pattern cluster 30. The only deviation from conventional procedures lies in the nature of the slurry itself. Since investing of the pattern occurs in a cold environment in order to maintain the temporary pattern cluster 30 in the solid state, the slurry must have a freezing temperature which is below the temperature at which investing of the temporary pattern takes place. Preferably, the slurry contains a sufficient amount of alcohol or equivalent fluid to keep the slurry liquid at a temperature at which the temporary pattern cluster 30 is maintained in the solid state. After the pattern cluster 30 has been invested with ceramic material as shown in FIG. 10, it is transferred to a warmer environment in which the temperature is above the freezing temperature of the temporary pattern and inverted as shown in FIG. 11. The warmer environment causes the pattern cluster 30 to melt so that the water 28 returns to its liquid state and drains from the ceramic shell 36 as shown in FIG. 12.

Figure 13:
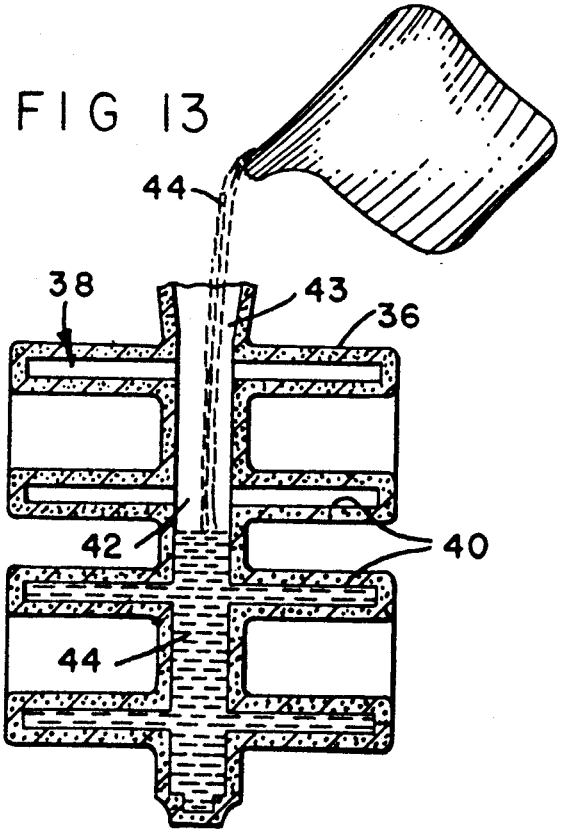
FIG. 13 is a vertical cross sectional view of the ceramic shell as the shell cavity is being filled with molten metal.
Figure 14:
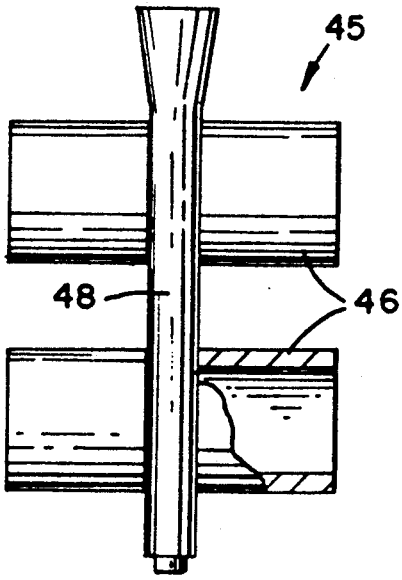
FIG. 14 is a front elevational view of a cluster of metal investment castings which have been produced by allowing the metal in the ceramic shell to solidify and the ceramic shell broken away from the castings.

Referring to FIG. 13, the ceramic shell 36 contains a cavity, generally indicated by the reference numeral 38, which includes a central sprue portion 42 and a plurality of configured portions 40 which extend from the sprue portion 42. The upper end of the sprue portions 42 has enlarged portion or cup 43. Each configured portion 40 has the exact geometry of the article which is to be formed, which by way of example is a short tubular cylindrical piece. The investment shell 36 is positioned in the upright position as shown in FIG. 12 after the water 28 has been evacuated from the cavity 38 and the shell has been heated to a high temperature i.e.: 1600° F. to 2000° F. as a preliminary step to casting. Molten metal, indicated by the reference numeral 44 in FIG. 13, is then poured into the open upper end of the cup 43 until the cavity 38 is completely filled with molten metal. The investment shell is allowed to cool to enable the metal to solidify. The investment shell is then broken away to expose the casting cluster, indicated by the reference numeral 45, in FIG. 14, which includes a sprue 48 and castings 46. The castings 46 are subsequently cut away from the sprue 48.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A method of making an investment casting comprising the following steps:
(a) forming a pattern which has the identical shape of the casting which is to be made,
(b) forming a mold of elastomeric material about said pattern,
(c) removing the pattern from said mold so that said mold has a cavity which has the identical shape of said pattern,
(d) filling said cavity with an aqueous material which is in its liquid state,
(e) cooling said mold until said aqueous material freezes to a solid state to form a temporary pattern which has the identical shape of the casting which is to be made,
(f) coating said temporary pattern with a ceramic material to form a self-supporting shell of ceramic material about said temporary pattern,
(g) heating the ceramic shell to melt said temporary pattern,
(h) evacuating the molten aqueous material from the shell so that a cavity is formed in said shell which has the identical shape of said casting,
(i) filling the cavity in said shell with molten metal,
(j) allowing said metal to solidify to form said casting, and
(k) removing the ceramic shell from said casting.

2. A method of making an investment casting as recited in claim 1, wherein said aqueous material is water.

3. A method of making an investment casting as recited in claim 2, wherein said temporary pattern is maintained at a temperature of less than 26° F. during said step of coating said temporary pattern with ceramic material.

4. A method of making an investment casting as recited in claim 1, wherein said temporary pattern is coated with ceramic material by repeated dippings of said temporary pattern in a slurry of ceramic particles and a second material which is liquid at a temperature at which said temporary pattern is solid and coating said temporary patterns with granular ceramic material.

5. A method of making an investment casting as recited in claim 4, wherein said second material includes at least some alcohol.

6. A method of making an investment casting as recited in claim 5, wherein said temporary pattern is coated with ceramic material by holding the extending portion of said rod and dipping said temporary pattern repeatedly in a slurry of alcohol based ceramic material.

7. A method of making an investment casting as recited in claim 1, wherein a rod is inserted in the cavity of said mold prior to the freezing of said aqueous material in the cavity so that a portion of the rod extends beyond the mold to serve as a handle for the temporary pattern for the subsequent step of coating said temporary pattern with ceramic material.

8. A method of making an investment casting as recited in claim 1, wherein said shell is preheated to a temperature of between 1600° F. and 2000° F. prior to filling the cavity in said shell with molten metal.

9. A method of making an investment coating as recited in claim 1, wherein said elastomeric material is silicone rubber.

10. A method of making an investment coating as recited in claim 1, wherein said elastomeric material is polysulfide urethane.

11. A method of making an investment casting from a pattern which has the identical shape of the casting to be made, said method comprising the following steps:
(a) forming a mold of elastomeric material about said pattern,
(b) removing the pattern from said mold so that said mold has a cavity which has the identical shape of said pattern,
(c) filling said cavity with an aqueous material which is in its liquid state,
(d) cooling said mold until said aqueous material freezes to a solid state to form a temporary pattern which has the identical shape of the casting which is to be made, and removing said temporary pattern from the mold,
(e) coating said temporary pattern with a ceramic material to form a self-supporting shell of ceramic material about said temporary pattern,
(f) heating the ceramic shell to melt said temporary pattern,
(g) evacuating the molten aqueous material from the shell so that a cavity is formed in said shell which has the identical shape of said casting,
(h) filling the cavity in said shell with molten metal,
(i) allowing said metal to solidify to form said casting, and
(j) removing the ceramic shell from said casting.

* * * * *